US009962007B2

(12) United States Patent
Mantzis

(10) Patent No.: US 9,962,007 B2
(45) Date of Patent: May 8, 2018

(54) MATTRESS CORE

(75) Inventor: George Mantzis, Campbellfield (AU)

(73) Assignee: MANTZIS HOLDINGS PTY LTD., Melbourne (AU)

( * ) Notice: Subject to any disclaimer, the term of this patent is extended or adjusted under 35 U.S.C. 154(b) by 86 days.

(21) Appl. No.: 12/792,836

(22) Filed: Jun. 3, 2010

(65) Prior Publication Data

US 2011/0072590 A1 Mar. 31, 2011

(30) Foreign Application Priority Data

Jun. 4, 2009 (AU) ..... 2009902576

(51) Int. Cl.

| | |
|---|---|
| ***A47C 23/04*** | (2006.01) |
| ***A47C 27/04*** | (2006.01) |
| ***A47C 27/05*** | (2006.01) |
| ***A47C 27/06*** | (2006.01) |

(52) U.S. Cl.

CPC ..... *A47C 23/04* (2013.01); *A47C 27/04* (2013.01); *A47C 27/05* (2013.01); *A47C 27/064* (2013.01)

(58) Field of Classification Search

CPC ..... A47C 23/04; A47C 27/04; A47C 27/05; A47C 27/064

USPC ..... 5/246, 249, 716, 717, 739

See application file for complete search history.

(56) References Cited

U.S. PATENT DOCUMENTS

| | | | | |
|---|---|---|---|---|
| 3,210,781 | A * | 10/1965 | Pollock | 5/718 |
| 4,998,310 | A * | 3/1991 | Olson | 5/710 |
| 5,701,623 | A * | 12/1997 | May | 5/739 |
| 6,052,851 | A * | 4/2000 | Kohnle | 5/690 |
| 6,397,419 | B1 * | 6/2002 | Mechache | 5/722 |
| 7,165,282 | B2 | 6/2007 | Watson | |
| 8,646,136 | B2 * | 2/2014 | Young et al. | 5/717 |
| 2003/0000021 | A1 * | 1/2003 | O'Connell et al. | 5/739 |
| 2007/0083996 | A1 * | 4/2007 | Wells | 5/717 |
| 2007/0204566 | A1 | 9/2007 | Lee | |
| 2007/0283668 | A1 | 12/2007 | Oh | |
| 2008/0092302 | A1 * | 4/2008 | Rensink | 5/690 |
| 2008/0295251 | A1 | 12/2008 | Flippin | |
| 2014/0165292 | A1 * | 6/2014 | Gladney | 5/717 |

FOREIGN PATENT DOCUMENTS

| | | | |
|---|---|---|---|
| GB | 2060540 | A | 5/1981 |
| WO | 2005039849 | A2 | 5/2005 |

* cited by examiner

*Primary Examiner* — David E Sosnowski

(74) *Attorney, Agent, or Firm* — Pillsbury Winthrop Shaw Pittman, LLP

(57) ABSTRACT

A mattress core, including an inner spring section; and a crush section overlying side sections and end sections of the inner spring section, wherein the crush section is resiliently compressible so as to reduce an end to end length of the mattress core and/or a side to side width of the mattress core for transportation.

10 Claims, 5 Drawing Sheets

MATTRESS CORE

CROSS-REFERENCE TO RELATED APPLICATIONS

This non-provisional application claims priority to Australian Patent Application No. 2009902576 filed Jun. 4, 2009, the entire contents of which is incorporated herein by reference in its entirety.

TECHNICAL FIELD OF THE INVENTION

The present invention relates to a mattress core; a mattress and a method of transporting a plurality of mattress cores in a shipping container.

BACKGROUND OF THE INVENTION

Mattresses have previously been transported in shipping containers from a manufacturer based in one country to distributors in foreign countries. With a trend towards manufacturing goods in low labour-cost countries, transport costs can represent a significant component of the ultimate base cost for a mattress. Accordingly, it is generally desirable to maximise the number of mattresses that can be transported in a shipping container. However, over-packing of mattresses into shipping containers can irreparably deform mattresses, rendering them unsaleable and/or unusable.

It is generally desirable to overcome or ameliorate one or more of the above mentioned difficulties, or at least provide a useful alternative.

SUMMARY OF THE INVENTION

In accordance with one aspect of the invention, there is provided a mattress core, including:

(a) an inner spring section; and (b) a crush section overlying side sections and end sections of the inner spring section, wherein the crush section is resiliently compressible so as to reduce an end to end length of the mattress core and/or a side to side width of the mattress core for transportation.

reduce a top and bottom thickness of the mattress core for transportation.

Preferably, the crush section includes side members and end members overlying respective side and end sections of the inner spring section.

Preferably, opposite end sections of each end member of said end members are coupled to corresponding end sections of the side members by fasteners.

Preferably, the fasteners are adhesives.

Preferably, the crush section is four inches thick.

In accordance with another aspect of the invention, there is provided a mattress including that above-described mattress core.

In accordance with another aspect of the invention, there is provided a method of transporting a plurality of mattress cores in a shipping container, including the steps of:

(a) arranging a mattress core, as above described, in a compressed condition of use by applying an end to end compressive force and/or a side to side compressive force to the mattress core;

(b) securing the mattress core in the compressed condition of use; and (c) loading the mattress core in the shipping container.

Preferably, the step of arranging the mattress core in a compressed condition of use includes the step of applying a top to bottom compressive force to the mattress core.

BRIEF DESCRIPTION OF THE DRAWINGS

Preferred embodiments of the present invention are hereafter described, by way of non-limiting example only, with reference to the accompanying drawing in which.

DETAILED DESCRIPTION OF PREFERRED EMBODIMENTS OF THE INVENTION

The mattress core 10 shown in FIGS. 1 to 4 includes an inner spring section 12; and a crush section 14 overlying side sections 16*a*, 16*b* and end sections 18*a*, 18*b* of the inner spring section 12. The crush section 14 is resiliently compressible so as to reduce an end to end length $L_{EE}$ of the mattress core 10 and/or a side to side width $W_{SS}$ of the mattress core 10 for transportation. The crush section 14 and the inner spring section 12 are resiliently compressible to reduce a top and bottom thickness $T_{TB}$ of the mattress core 10 for transportation. The crush section 14 is preferably made of high density foam and is preferably four inches thick.

The crush section 14 includes side members 20*a*, 20*b* and end members 22*a*, 22*b* overlying respective side sections 16*a*, 16*b* and end sections 18*a*, 18*b* of the inner spring section 12. As particularly shown in FIG. 1, opposite end sections 24*a*, 24*b* of each end member 22*a*, 22*b* are coupled to corresponding end sections 26*b*, 26*a* of the side members 20*a*, 20*b* by fasteners. The fasteners are preferably adhesives.

In the example shown, the opposite end sections 24*a*, 24*b* of each end member 22*a*, 22*b* interleave with corresponding end sections 26*b*, 26*a* of the side members 20*a*, 20*b*. The interleaving increases the contact area between the members 20*a*, 20*b*, 22*a*, 22*b* to thereby form stronger connections. Opposite end sections 24*a*, 24*b* of each end member 22*a*, 22*b* 20*b* with dovetail joints (not shown).

Figure 1:
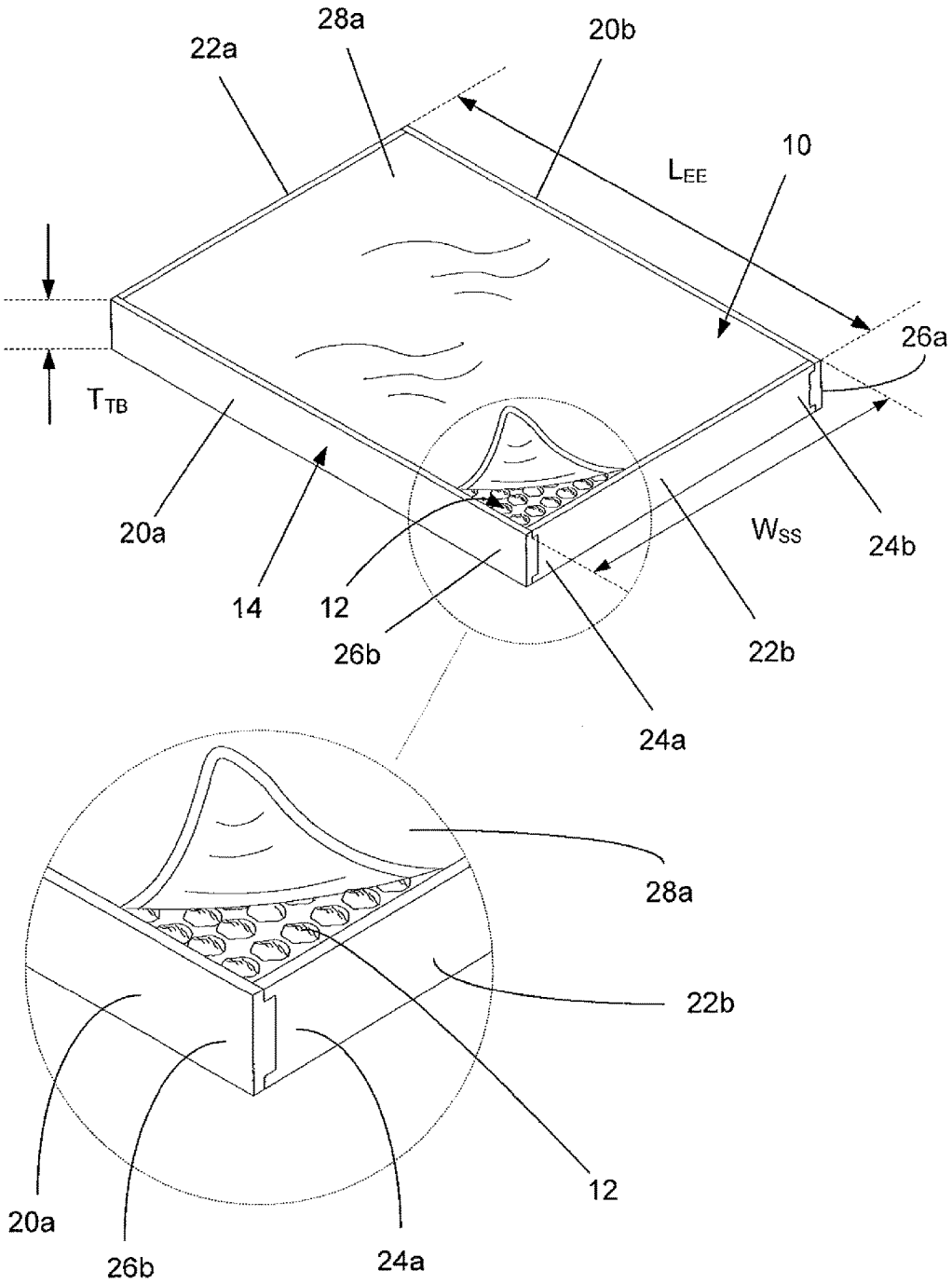
FIG. 1 is a top perspective view of a mattress core.
Figure 2:
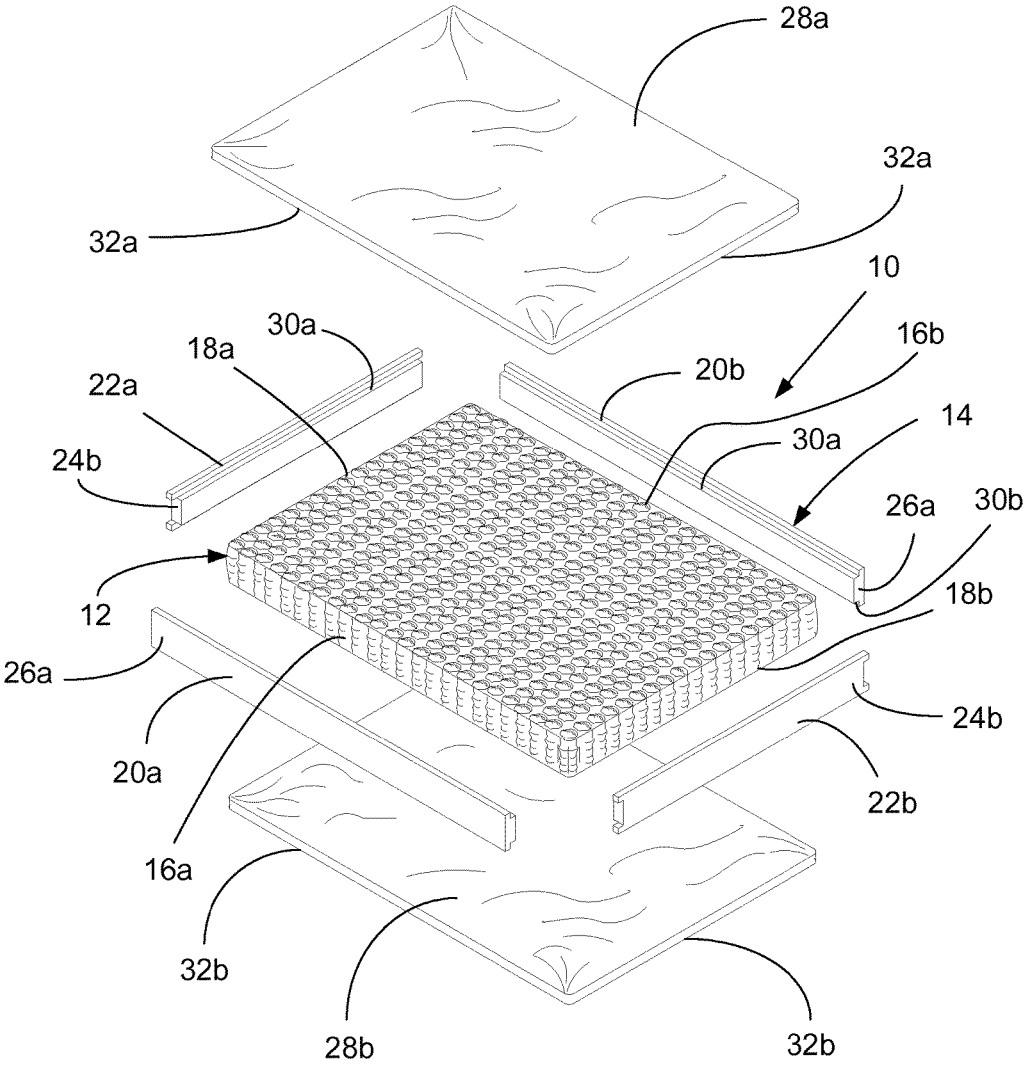
FIG. 2 is a top perspective exploded view of the mattress core shown in FIG. 1.

As particularly shown in FIG. 2, the mattress core 12 includes top and bottom covering sections 28*a*, 28*b* shaped to overlie respective top and bottom sides of the inner spring section 12. The top and bottom covering sections are preferably half the thickness $T_{CS}$ of the crush section 14.

Figure 3:
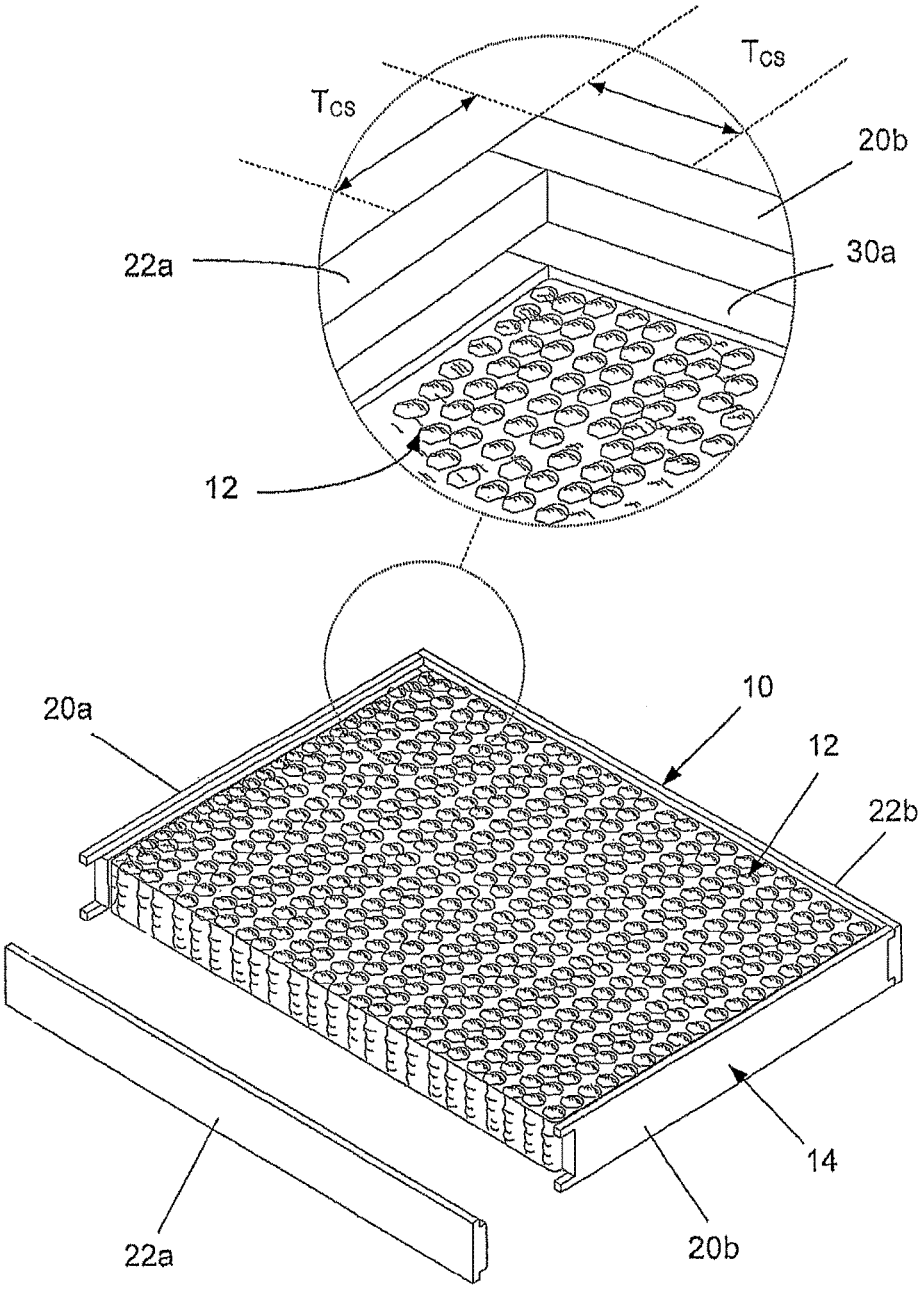
FIG. 3 is a top perspective view of the mattress core shown in FIG. 2 arranged in another condition of use.
Figure 4:
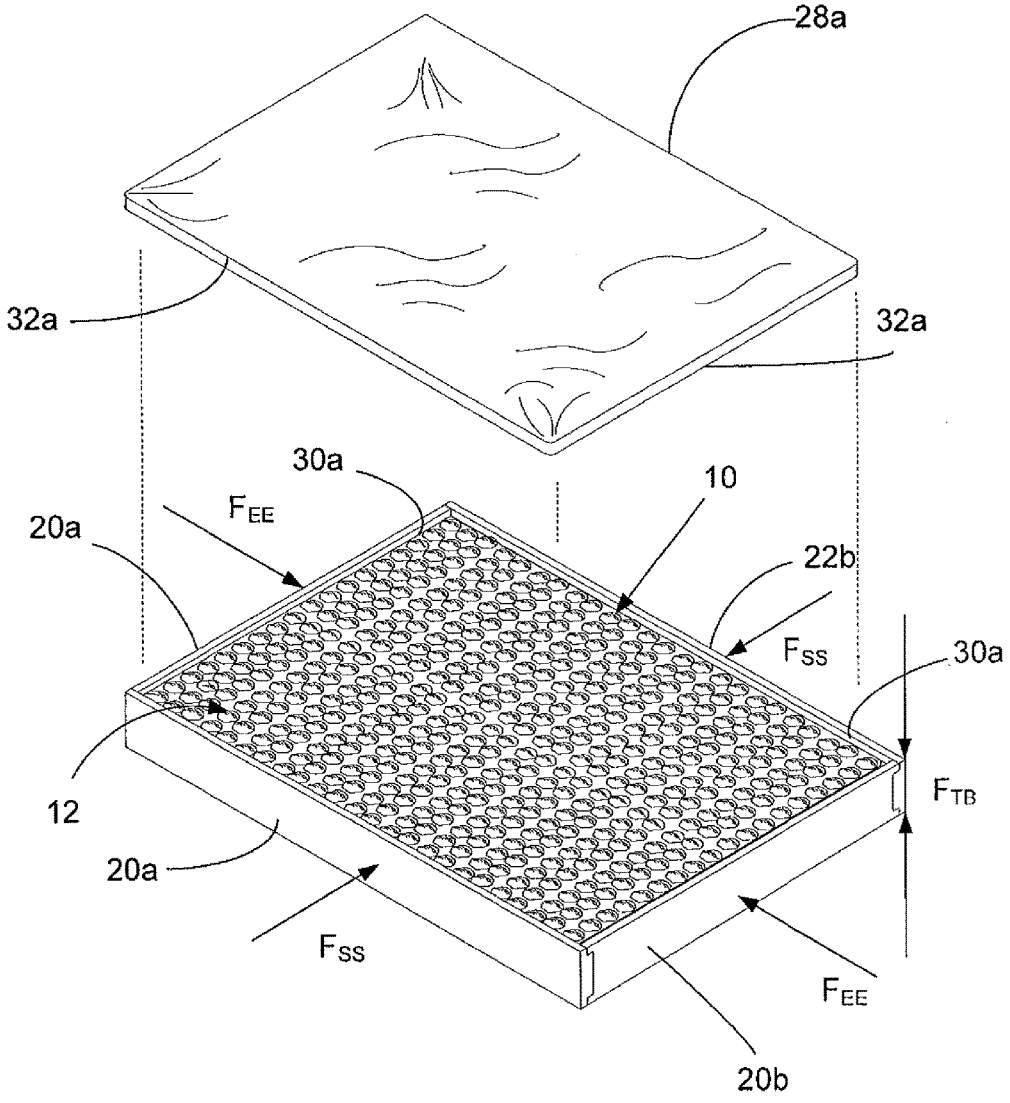
FIG. 4 is a top perspective view of the mattress core shown in FIG. 2 arranged in yet another condition of use.

As particularly shown in FIGS. 2 and 3, the crush section 14 includes top and bottom inner peripheral ledges 30*a*, 30*b* shaped to receive outer peripheral edge sections 32*a*, 32*b* of respective ones of the top and bottom covering sections 28*a*, 28*b*. The outer peripheral edge sections 32*a*, 32*b* of the top and bottom covering sections 28*a*, 28*b* are coupled to respective ledges 30*a*, 30*b* by fasteners. The fasteners are preferably adhesives. Each covering sections 28*a*, 28*b* is thereby fastened to the side members 20*a*, 20*b* and the end members 22*a*, 22*b* of the crush section 14. The covering sections 28*a*, 28*b* provide additional strength to the crush section 14.

The mattress core 10 can be compressed into a smaller size for the purposes of transport and also allows for decompression of the mattress core 10 back to its original size without any harm to the integrity of the mattress core 10 and its subsequent use. A further benefit of the mattress core 10 is the method of construction of the mattress providing more robust construction compared to existing styles of construction.

The inner spring section 12 is smaller than current mattress styles and the thickness $T_{CS}$ of the crush section 14 is concomitantly larger than current box-foam perimeters. The crush section 14 is preferably made of high density foam which can compress and decompress without deformation of the original shape. By using thick foam for the crush section 14 and reducing the inner spring section 12 by a similar concomitant amount, the overall mattress core 10 size can remain within standard sizes (such as King, Queen, Single etc.). However, the mattress core 10 can offer significant size reduction at the time of stacking into shipping containers (or other transport spaces).

The thickness $T_{CS}$ of the crush section 14 will vary depending on the need to keep structural integrity of the mattress core 10 and avoid loss of rigidity across the major surface of the mattress core 10. The thickness $T_{CS}$ of the crush section 14 will preferably be up to 15%-20% of the length $L_{EE}$ of the mattress core 10.

A plurality of mattress cores 10 can be packed into shipping containers for transportation by following the steps of:

(a) arranging a mattress core 12 in a compressed condition of use by applying an end to end compressive force $F_{EE}$ and/or a side to side compressive force $F_{SS}$ to the mattress core 10;

(b) securing the mattress core 10 in the compressed condition of use; and (c) loading the mattress core 10 in the shipping container.

The step of arranging the mattress core in a compressed condition of use preferably includes the step of applying a top to bottom compressive force $F_{TB}$ to the mattress core.

Figure 5:
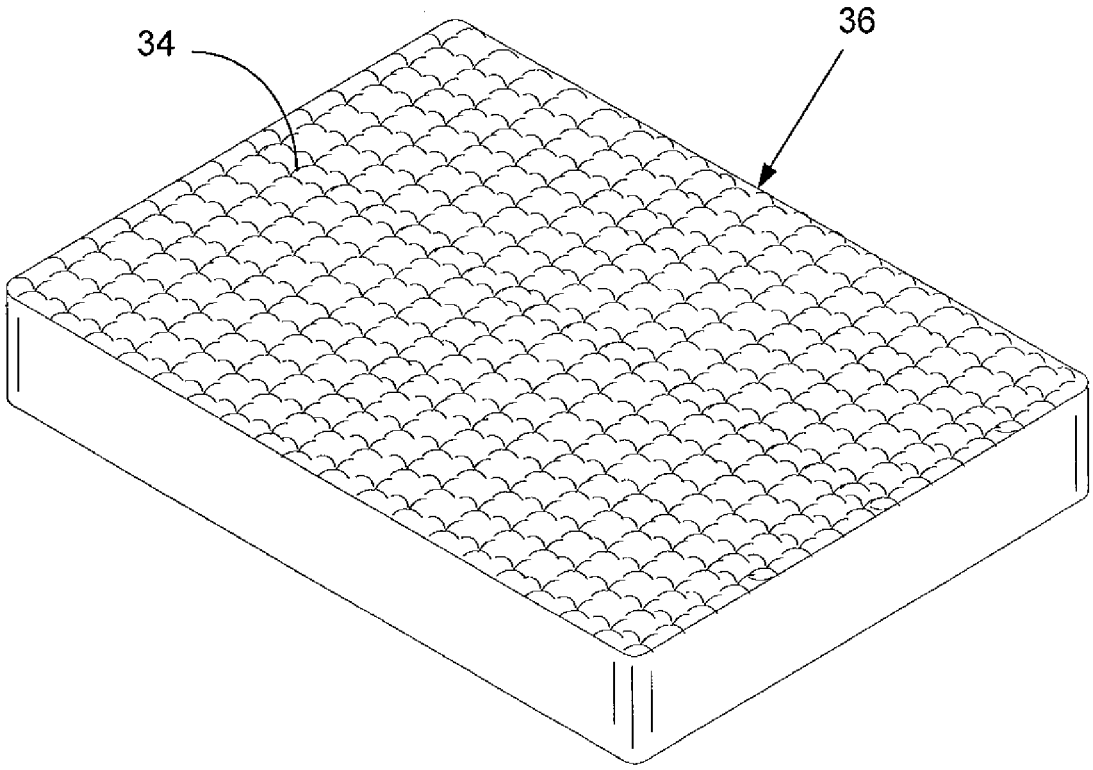
FIG. 5 is a top perspective view of a mattress including the mattress core shown in FIG. 1.

On arrival at its destination, the container ship is unpacked and the mattress cores 10 are released from their compressed condition of use. Each mattress core 10 is then sewn into a mattress casing 34 to form the completed mattress 36 shown in FIG. 5.

The crush section 14 is preferably made of Visco™ Elastic Foam. The inner spring mattress is preferably Pocket Coil; LFK; Continous Coil; or Bonnell Spring.

In current mattress construction the foam sides of the inner spring mattresses are thinner and the gluing surface area is narrower. Also the thinner side walls do not provide sufficient thickness for channelling a ledge at all. This results in the top and bottom layer of foam covering the major face of the mattress not being fitted within the side wall. Currently, the top and bottom layer of foam are glued directly across the top edge of the side walls and there is an increased risk that the foam will peel away at the corners of the mattress.

While we have shown and described specific embodiments of the present invention, further modifications and improvements will occur to those skilled in the art. We desire it to be understood, therefore, that this invention is not limited to the particular forms shown and we intend in the append claims to cover all modifications that do not depart from the spirit and scope of this invention.

Throughout this specification, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference to any prior art in this specification is not, and should not be taken as, an acknowledgment or any form of suggestion that the prior art forms part of the common general knowledge in Australia.

LIST OF PARTS

10 Mattress core
12 Inner spring section
14 Crush section
16*a*, 16*b* Side section
18*a*, 18*b* End section
20*a*, 20*b* Side member
22*a*, 22*b* End member
24*a*, 24*b* End section of end member
26*a*, 26*b* End section of side member
28*a*, 28*b* Covering section
30*a*, 30*b* Ledge
32*a*, 32*b* Edge section of covering section
34 Mattress casing
36 Mattress

The invention claimed is:

1. A mattress core arranged to be resiliently compressed for storage in a shipping container, the mattress core comprising:

(a) an inner spring section comprising side sections, end sections, and top and bottom sides;

(b) a crush section coupled to and extending beyond the periphery of the side sections and end sections of the inner spring section, wherein the thickness of the crush section is 15% to 20% of an end to end length of the mattress core, and (c) top and bottom covering sections attached to the crush section and shaped to overlie and extend beyond the periphery of respective top and bottom sides of the inner spring section, wherein the portions of the top and bottom covering sections that extend beyond the periphery of respective top and bottom sides of the inner spring section comprise outer peripheral edge sections;

wherein the crush section includes top and bottom inner peripheral ledges that are shaped to receive the outer peripheral edge sections of respective ones of the top and bottom covering sections;

wherein the outer peripheral edge sections are coupled to the respective top and bottom inner peripheral ledges by fasteners; and wherein the crush section is resiliently compressible so as to reduce the end to end length of the mattress core and a side to side width of the mattress core when compressed so that more mattress cores can be stored in a shipping container.

2. The mattress core claimed in claim 1, wherein the crush section and the inner spring section are resiliently compressible to reduce a top and bottom thickness of the mattress core for transportation.

3. The mattress core claimed in claim 1, wherein the crush section includes side members and end members overlying respective side and end sections of the inner spring section.

4. The mattress core claimed in claim 3, wherein opposite end sections of each end member of said end members are coupled to corresponding end sections of the side members by fasteners.

5. The mattress core claimed in claim 4, wherein the fasteners are adhesives.

6. The mattress core claimed in claim 3, wherein opposite end sections of each end member of said end members interleave with corresponding end sections of the side members.

7. The mattress core claimed in claim 6, wherein said opposite end sections of each end member of said end members are coupled to corresponding end sections of the side members with dovetail joints.

8. The mattress core claimed in claim 1, wherein the fasteners are adhesives.

9. The mattress core claimed in claim 1, wherein a top and bottom thickness of the crush section is four inches.

10. A mattress comprising the mattress core claimed in claim 1.

* * * * *